US006227471B1

(12) United States Patent
Virving

(10) Patent No.: US 6,227,471 B1
(45) Date of Patent: May 8, 2001

(54) FEEDING ELEMENT FOR FIBROUS MATERIAL

(75) Inventor: Nils Virving, Stockholm (SE)

(73) Assignee: Valmet Fibertech Aktiebolag (SE)

( * ) Notice: Subject to any disclaimer, the term of this patent is extended or adjusted under 35 U.S.C. 154(b) by 0 days.

(21) Appl. No.: 09/341,862

(22) PCT Filed: Feb. 5, 1998

(86) PCT No.: PCT/SE98/00204

§ 371 Date: Jul. 19, 1999

§ 102(e) Date: Jul. 19, 1999

(87) PCT Pub. No.: WO98/37271

PCT Pub. Date: Aug. 27, 1998

(30) Foreign Application Priority Data

Feb. 25, 1997 (SE) ..... 9700678

(51) Int. Cl.[7] ..... B02C 1/08
(52) U.S. Cl. ..... 241/244
(58) Field of Search ..... 241/246, 247, 241/261.2, 261.3, 244

(56) References Cited

U.S. PATENT DOCUMENTS 3,902,673 * 9/1975 Berggren ..... 241/246
3,957,214 * 5/1976 Berggren ..... 241/246
4,220,290 * 9/1980 Johansson ..... 241/247
4,355,767 10/1982 Johansson et al. ..... 241/244
5,040,736 * 8/1991 Obitz ..... 241/247

* cited by examiner

*Primary Examiner*—Rodney A. Butler
(74) *Attorney, Agent, or Firm*—Lerner, David, Littenberg, Krumholz & Mentlik, LLP

(57) ABSTRACT

A feeding element is disclosed for use in connection with a refiner for lignocellulosic fibrous material including a stationary refiner, a rotary refiner mounted for rotation in juxtaposition with the stationary refiner thereby forming a refining gap therebetween, a feeder for feeding the lignocellulosic fibrous material centrally to a feed zone within the refining gap and a refining zone extending radially outward from the feed zone, the feeding element including a feeder with an upper surface for mounting on the rotary refiner at a location displaced outwardly from and directly adjacent to the central location of the feed zone, the feeder including at least one radial feed bar projecting from the upper surface of the feeder, the at least one radial feed bar including a body and a projecting portion extending laterally from the body at a location displaced from the upper surface of the feeder.

7 Claims, 3 Drawing Sheets

FEEDING ELEMENT FOR FIBROUS MATERIAL

FIELD OF THE INVENTION

The present invention relates to a device for working lignocellulosic fibrous material in a refiner with opposed refining means rotating relative to each other, one of which is stationary and one rotary, provided with refining elements, which between themselves form a refining gap with a refining zone for working the material. More particularly, the present invention relates to such a device in which the lignocellulosic material is supplied through a central opening in the stationary refining means to a feed zone located radially inside the refining zone, and most particularly, to a feeding element for the material, which is intended to be placed directly outside a central feeding device on the rotary refining means. The feeding element according to the present invention can be used in a refiner for the manufacture of various types of mechanical pulps, such as refiner mechanical pulp (RMP), thermomechanical pulp (TMP), chemimechanical pulp (CMP) and chemi-thermomechanical pulp (CTMP). The starting material can be wood chips or more or less worked pulp.

BACKGROUND OF THE INVENTION

In connection with the above-referenced type of refiners, in the inner portion of the feed zone the effect of centrifugal force on the supplied material is low. For this reason, the material supplied through the opening in the stationary refining means is generally not fed sufficiently rapidly through the feed zone to the refining zone, which is located radially outward from the feed zone. As a result, the material can clog in the feed zone, which results in friction losses and non-uniform feed, which in turn leads to a deterioration in the pulp quality. In order to overcome these problems, mechanical feeding devices can be arranged in the feed zone.

However, even if the material is transported out through the feed zone by means of central feeding devices, problems can still arise when it enters the refining zone in the refining gap. The material can thus be subjected to braking forces and to an ineffective mechanical action, which causes heat development and results in the material not being adequately worked. This results in unnecessarily high energy consumption.

SUMMARY OF THE INVENTION

In accordance with the present invention, this and other objects have now been realized by the invention of a feeding element for use in connection with a refiner for lignocellulosic fibrous material including a stationary refining member, a rotary refining member mounted for rotation in juxtaposition with the stationary refining member thereby forming a refining gap therebetween, a feeder for feeding the lignocellulosic fibrous material centrally to a feed zone within the refining gap and a refining zone extending radially outward from the feed zone, the feeding element comprising a feeding member having an upper surface for mounting on the rotary refining member at a location outwardly displaced from and directly adjacent to the central location of the feed zone, the feeding member including at least one radial feed bar projecting from the upper surface of the feeding member, the at least one radial feed bar including a body portion and a projecting portion extending laterally from the body portion at a location displaced from the upper surface of the feeding member. Preferably, the body portion includes a first side and a second side, and the projecting portion extends laterally from both the first and second sides of the body portion.

In accordance with one embodiment of the feeding element of present invention, the feeding element includes a plurality of the radial feed bars, and wherein the projecting portions extending laterally from each of the plurality of radial feed bars are spaced from adjacent ones of the projecting portions.

In accordance with another embodiment of the feeding element of the present invention, the feeding element includes a plurality of the radial feed bars, and wherein the projecting portions extending laterally from each of the plurality of radial feed bars are connected to adjacent ones of the projecting portions to form bridges between the plurality of radial feed bars, thereby creating closed channels beneath the bridges.

In accordance with another embodiment of the feeding element of the present invention, the feeding element includes a plurality of the radial feed bars extending substantially over the entire upper surface of the feeding member.

In accordance with another embodiment of the feeding element of the present invention, the outer portion of the feeding element extending radially from the feeding member includes a plurality of radially projecting bars for working the lignocellulosic fibrous material.

In accordance with another embodiment of the feeding element of the present invention, the feeding element comprises an annular feeding element extending entirely around the rotary refining member.

The feeding element according to the present invention thereby offers a solution to the aforesaid problems, in that it brings about a continued effective feed of the material and at the same time its acceleration from the feed zone, as well as some distance into the refining gap. Due to such effective feeding, the energy consumption in the refiner is thereby reduced.

The refining element according to the present invention comprises at least one feeding bar in which the upper edge of each feeding bar projects out at least on one side of the bar. The feeding element is intended to be placed on the rotary refining means in the refining gap directly outside the central feeding device, which can be attached to the rotary refining means or be a separate screw feeder extending into the refining gap between the refining means. The feeding bar or bars of the feeding element can be angular in relation to the radius in order to bring about optimum feeding. Alternatively, the feeding bar or bars can be radial in order to allow reversible motion while at the same time maintaining the feeding of the lignocellulosic material. In a preferred embodiment, the upper edge of the feeding bar projects out symmetrically from both sides of the bar.

BRIEF DESCRIPTION OF THE DRAWINGS

The present invention is described in greater detail in the following detailed description, which in turn refers to the accompanying drawings, in which.

DETAILED DESCRIPTION

Figure 1:
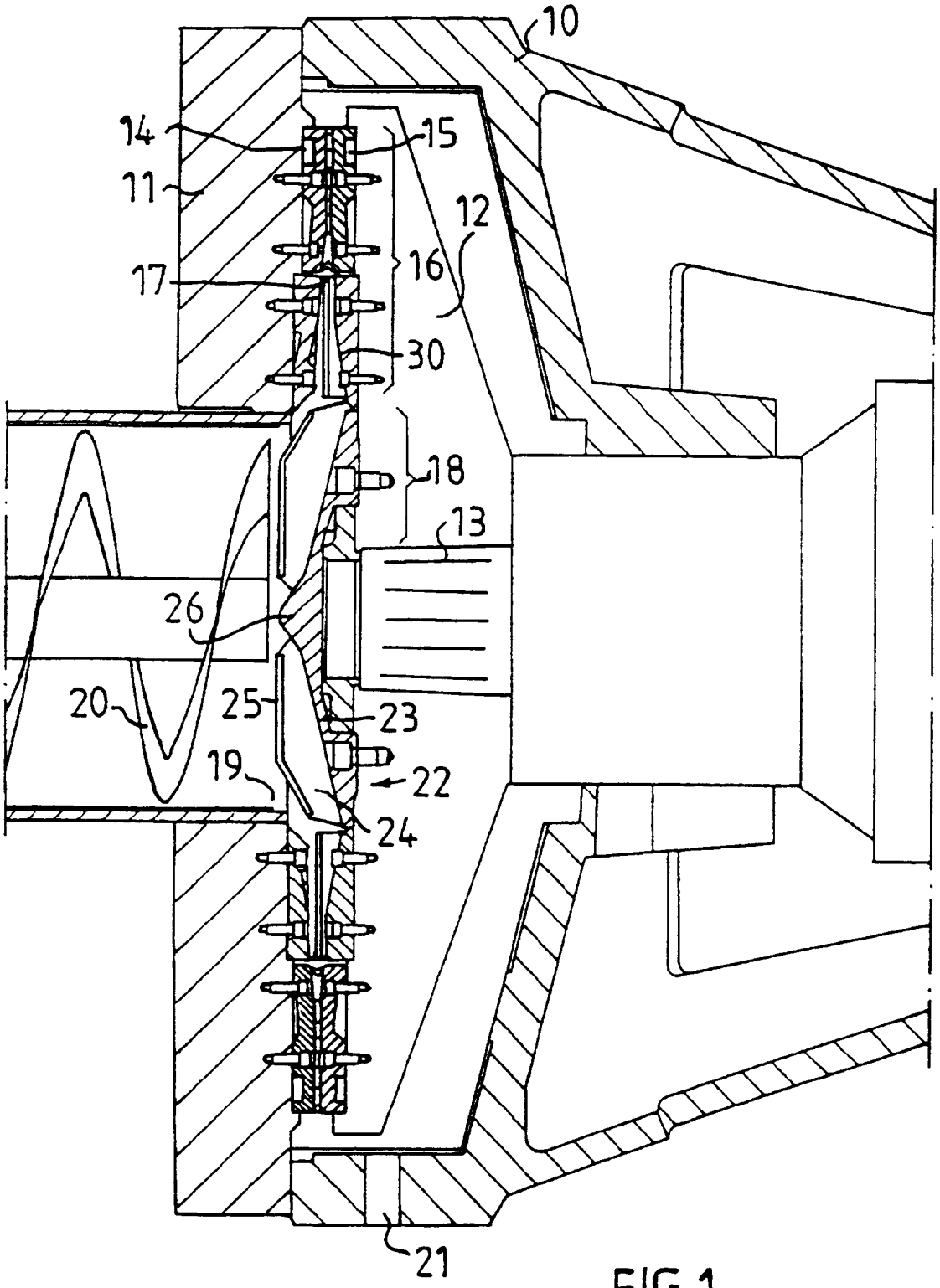
FIG. 1 is a side, elevational, cross-sectional view through a refiner with a feeding element according to the present invention.
Figure 2:
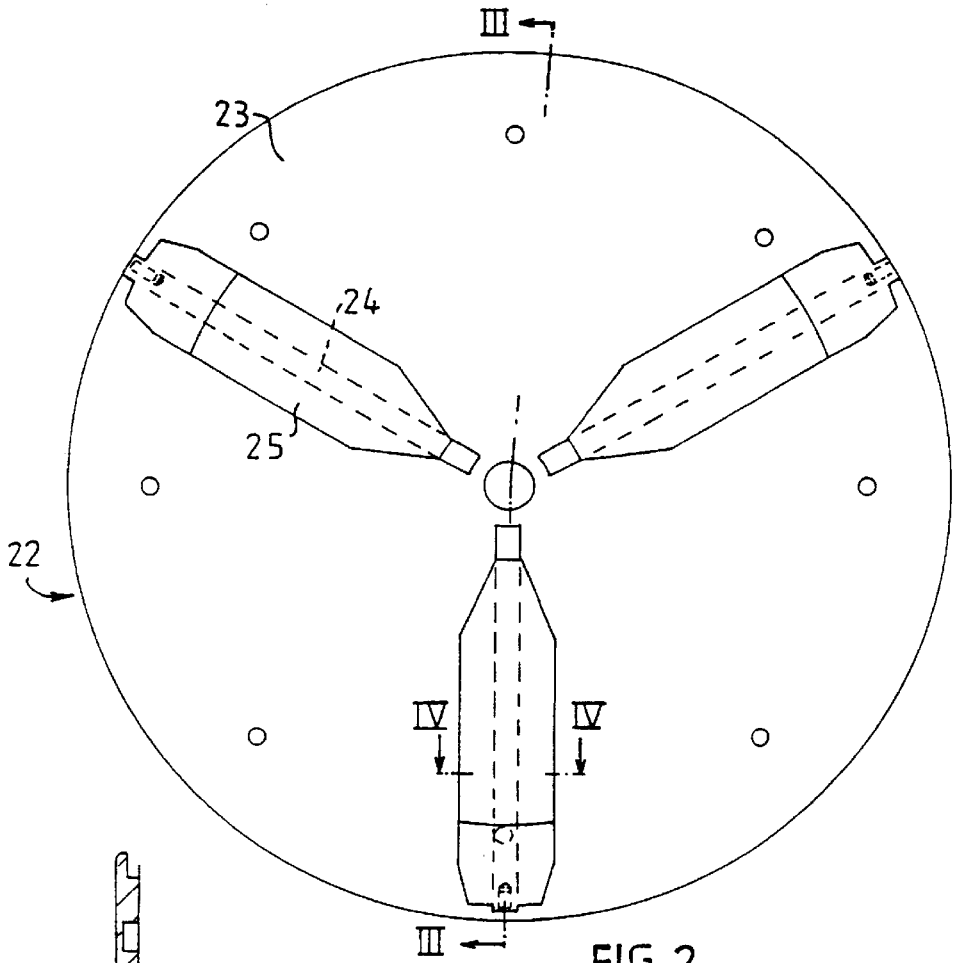
FIG. 2 is a front, elevational view of a central feeding device for use in connection with the present invention.
Figure 3:
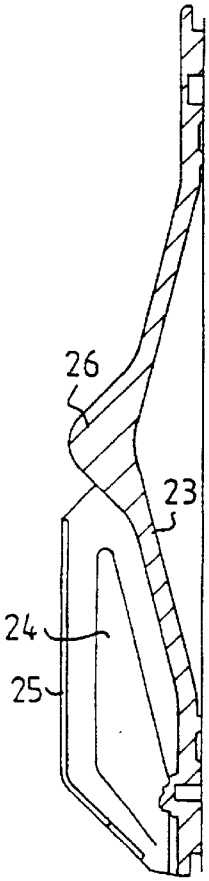
FIG. 3 is a side, elevational, partial, cross-sectional view, taken along III—III in FIG. 2.
Figure 4:
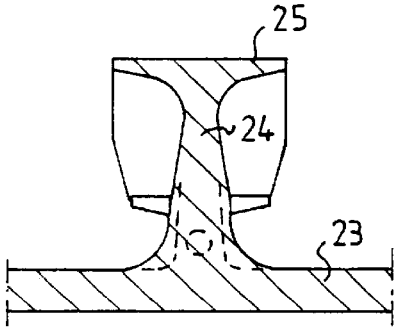
FIG. 4 is a side, elevational, partial, cross-sectional view taken along IV—IV in FIG. 2.

The refiner shown in FIG. 1 comprises a refiner housing 10, in which a stationary refining means 11 (in this case the end wall of the refiner housing) and an opposed rotary refining means 12, attached to a rotary shaft 13, are provided. The refining means, 11 and 12, are provided with refining elements, 14 and 15, respectively, which between them form a refining zone 16 in a refining gap 17. The refining gap 17 comprises a feed zone 18 located inside the gap. The stationary refining means 11 is formed with a central feed opening 19 for the material to be worked. A screw feeder 20 for this material is connected to the feed opening 19. The refiner housing 10 is provided with an outlet 21 for the material passing through the refining gap where it is worked.

A central feeding device 22 is located on the rotary refining means, which comprises a circular disk 23 with strips 24 extending from a position close to the center radially outward towards the circumference of the disk. The number of strips can be one or more, and preferably from about 2 to 4. The strips along the greater portion of their upper edges are provided with a roof 25, which projects outward symmetrically on both sides of the strips.

The disk 23 is formed with a hub 26, from which three radial strips 24 extend. The roof 25 leaves an opening at the hub and follows the strips 24 outwardly. The height of the strips decreases outwardly in order to adapt to the outside located and outwardly tapering refining zone 16. The disk 23 has a diameter corresponding to the diameter of the feed opening 19.

The feeding device 22 is designed symmetrically in order to bring about feed in both directions of rotation. Alternatively, the feeding device can be designed for rotation in only one direction.

It is also possible, that the central feeding device consists of a screw feeder 20, which then extends in through the feed opening 19.

A feeding element 30 is located on the rotary refining means 12 in the refining gap 17 directly outside (radially) the feeding device 22. The feeding element 30 is formed with one or more radial feeding bars 31.

Figure 5:
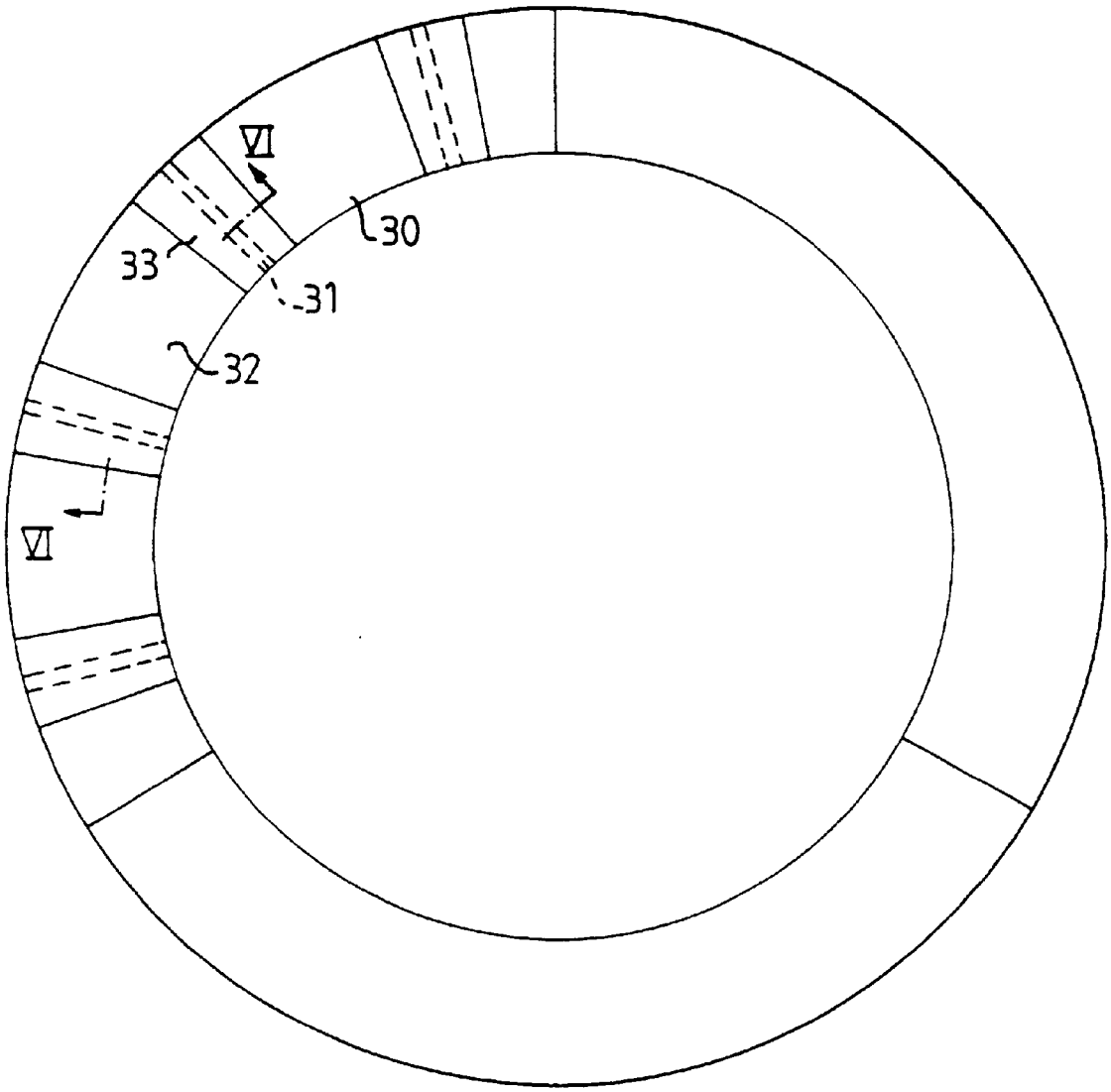
FIG. 5 is a front, elevational, partial view of an embodiment of a feeding element according to the present invention.

The feeding element can extend as a zone around the entire refining means 12 or consist of a portion of a zone, and together with other feeding elements extend around the refining means 12. According, to FIG. 5, the number of feeding elements is three, but other numbers can suitably be utilized. In order to bring about an increased feeding effect, the feeding bars 31 can instead be angularly disposed in relation to the radius. This implies, however, that they operate only in one rotation direction.

The feeding bars 31 of the feeding element 30 are formed with upper edges 33 projecting outwardly symmetrically on both sides of the bars. The upper surface of these upper edges 33 can be flat, and the feeding bars 31 can extend across the refining gap 17 to the opposed stationary refining means 11, the corresponding zone of which should have a smooth surface. The distance between the upper edges 33 of the feeding bars and the opposed refining means 11 should be short. The feeding element 30 should be placed on the rotary refining means 12, so that a feeding bar 31 is located directly in front of a strip 24 on the feeding device 22.

Figure 6:
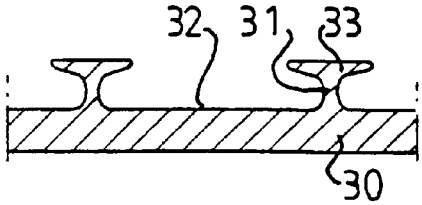
FIG. 6 is a side, elevational, partial, cross-sectional view taken along VI—VI in FIG. 5.
Figure 7:
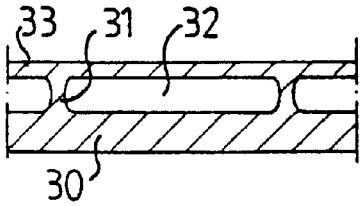
FIG. 7 is a side, elevational, partial, cross-sectional view of a variation of the embodiment of the present invention shown in FIG. 6.

According to FIG. 6, the projecting upper edges 33 of adjacent feeding bars 31 are arranged spaced from each other, so that they bridge grooves 32 only partially. According to the variant shown in FIG. 7, these upper edges are designed so as to totally bridge the grooves 32, so that closed radial channels are formed in this embodiment.

Radially outside the feeding elements 30 both refining means, 11 and 12, are provided with refining elements for working the material. The refiner shown therein has plane refining means, but it is also possible to provide the outer portion of the refining gap with a conical shape. Alternatively, the radially outer portion of the feeding element 30 can be provided with conventional bars for working the material in co-operation with bars on the opposed stationary refining means 11. The number of conventional bars should then be higher than the number of feeding bars.

The material, which by the screw feeder 20 is fed into the refiner, is caught under the roof 25 and accelerated outwardly along the strips. The material is transferred from the feeding device 22 to the grooves 32 of the feeding element 30, which effectively move the material into the refining zone 16 of the refining gap 17. Due to the presence of the projecting upper edges 33 of the bars 31, the feed along the grooves 32 takes place with the effect of the centrifugal force without being braked against the opposed stationary refining means 11.

The material is thus transferred effectively and uniformly to the refining zone 16 without being disturbed by rearwardly flowing steam.

The working of the lignocellulosic material takes place farther away from the center and thereby at a higher relative speed between the refining means, 11 and 12. On the whole, this implies reduced specific energy consumption for working the material to form a pulp.

The alternative configuration with an outer zone of conventional bars on the feeding element 30 causes the transition from feeding to refining to proceed more gradually, which can result in a more uniform material flow through the refiner.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A feeding element for use in connection with a refiner for lignocellulosic fibrous material including a stationary refining member, a rotary refining member mounted for rotation in juxtaposition with said stationary refining member thereby forming a refining gap therebetween, a feeder for feeding said lignocellulosic fibrous material centrally to a feed zone within said refining gap and a refining zone extending radially outward from said feed zone, said feeding element comprising a feeding member having an upper surface for mounting on said rotary refining member at a location outwardly displaced from and directly adjacent to said central location of said feed zone, said feeding member including at least one radial feed bar projecting from said upper surface of said feeding member, said at least one radial feed bar including a body portion and a projecting portion extending laterally from said body portion at a location displaced from said upper surface of said feeding member.

2. The feeding element of claim 1 wherein said body portion includes a first side and a second side, and said projecting portion extends laterally from both said first and second sides of said body portion.

3. The feeding element of claim 1 including a plurality of said radial feed bars, and wherein said projecting portions extending laterally from each of said plurality of radial feed bars are spaced from adjacent ones of said projecting portions.

4. The feeding element of claim 1 including a plurality of said radial feed bars, and wherein said projecting portions extending laterally from each of said plurality of radial feed bars are connected to adjacent ones of said projecting portions to form bridges between said plurality of radial feed bars, thereby creating closed channels beneath said bridges.

5. The feeding element of claim 1 including a plurality of said radial feed bars extending substantially over said entire upper surface of said feeding member.

6. The feeding element of claim 1 wherein the outer portion of said feeding element extending radially from said feeding member includes a plurality of radially projecting bars for working said lignocellulosic fibrous material.

7. The feeding element of claim 1 wherein said feeding element comprises an annular feeding element extending entirely around said rotary refining member.

* * * * *